US005578785A

United States Patent [19]

Fiederling

[11] Patent Number: 5,578,785

[45] Date of Patent: Nov. 26, 1996

[54] METAL COMPLEX COMPOUNDS

[75] Inventor: Nikolaus Fiederling, Leverkusen, Germany

[73] Assignee: Dynamit Nobel Aktiengesellschaft, Troisdorf, Germany

[21] Appl. No.: 501,342

[22] Filed: Jul. 12, 1995

[51] Int. Cl.$^6$ ..... C06C 7/00

[52] U.S. Cl. ..... 102/202.5; 546/12; 149/23

[58] Field of Search ..... 546/12, 255, 301; 149/23; 102/202.5

[56] References Cited

FOREIGN PATENT DOCUMENTS 3920336 1/1991 Germany .

9221317 12/1992 WIPO .

*Primary Examiner*—Charles T. Jordan
*Assistant Examiner*—John R. Hardee
*Attorney, Agent, or Firm*—Antonelli, Terry, Stout & Kraus

[57] ABSTRACT

Metal complex compounds having the general formula $Me(DADPyOx)_x$ wherein Me stands for a transition metal ion, DADPyOx stands for 2,6-diamino-3,5-dinitropyridine-1-oxide and x represents an integer of 1, 2, 3, or 4. These compounds are useful as insensitive, high-energy explosives.

11 Claims, No Drawings

METAL COMPLEX COMPOUNDS

FIELD OF THE INVENTION

The present invention relates to novel metal complex compounds with the general formula $Me(DADPyOx)_x$ in which Me stands for a transition metal ion, DADPyOx stands for 2,6-diamino-3,5-dinitropyridine-1-oxide and x stands for 1, 2, 3 or 4, a method of preparation thereof, and the application thereof as explosives, especially secondary explosives. These compounds may be used alone or with other explosives to produce blasting caps, combustion moderators, etc.

BACKGROUND OF THE INVENTION

Accidents with guns and weapon systems attributable to the sensitivity of the explosive have reinforced the search for insensitive but nonetheless efficient explosives over the last few years. While in the framework of LoVA ("Low Vulnerable Ammunition") concept the search for insensitive weapon systems is in the foreground, IHE ("Insensitive High Explosive") is being investigated in the framework of one aspect of this concept. Essentially two paths have been taken in bringing this aspect to fruition:

a) deliberate synthesis of novel, high-energy, insensitive compounds, and b) desensitization of explosives that are as high-energy as possible and sensitive; for example, incorporation of RDX or HMX into wax or plastic matrices.

The manufacture of high-energy, insensitive explosives, which is the goal in view, is often possible only by complicated methods of synthesis which have low yields and are hence expensive. Explosives made in this way are accordingly of low economic significance. It is true that, from the economic standpoint, desensitization of known high-energy explosives does offer advantages, whose economic significance can be estimated, but it is associated with all the known problems of multiphase systems such as interface problems, homogeneity, etc. and frequently requires a considerable industrial effort.

SUMMARY OF THE INVENTION

Accordingly, the goal of the present invention is to prepare novel, insensitive, high-energy explosives in a simple manner.

This goal is achieved by metal complex compounds represented by the formula Me(DADPyOx)x wherein Me stands for a transition metal ion, DADPyOx stands for 2,6-diamino-3,5-dinitropyridine-1-oxide and x represents an integer of 1, 2, 3, or 4 which can be made by the method involving reaction of a transition metal with DADPyOx to form the complex compound. The electronic environment of the starting substance is changed by complexing specific ligands with specific complex formers, which makes it possible to vary the bonding forces. However, a change in bonding forces also brings about a change in the properties of the starting substance. In this connection reference is made to the cyclopentadiene/ferrocene system. While cyclopentadiene has a boiling point of 40° C., its complex compound with Fe(II) ferrocene, does not decompose below 500° C.

The choice of specific starting compounds which, because of their structures, can serve as ligands for complex-forming metals is of critical significance for the solution according to the invention. Only when specific ligands are chosen can the goal of the invention of preparing novel, insensitive, high-energy explosives be achieved. While aminonitroguanidine (ANQ) can be reacted to copper-bis-aminonitroguanidine nitrate with the complex-former $Cu^{2+}$, the complex decomposes at only approximately 90° C. while the starting compound, ANQ, does not decompose until a temperature of 184° C. is reached.

According to the invention, 2,6-diamino-3,5-dinitro-pyridine-1-oxide, hereinafter designated as DADPyOx, is selected and complexed. DADPyOx is an explosive with high energy and is relatively temperature-stable (as described in DE-OS 39 20 336, the disclosure of which is incorporated herein by reference). For example, DADPyOx can be obtained by denitrating 2,6-diaminopyridine followed by oxidation, with hydrogen peroxide, of the 2,6-diamino-3,5-dinitropyridine obtained after nitration. This compound has the following structural formula:

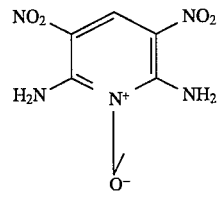

Because of its structure, DADPyOx can be complexed with transition metal ions. The ions of the transition metals used for the present invention are ions of the transition metals selected from the group consisting of copper, nickel, cobalt, iron, silver and zinc in their various possible oxidation states.

The novel compounds according to the invention are prepared by suspending DADPyOX in a suitable suspension medium, e.g. glacial acetic acid, dimethylformamide, or water, preferably in glacial acetic acid, and adding the corresponding transition metal salt, for example, the corresponding chloride, sulfate, carbonate, or nitrate, preferably the corresponding transition metal nitrate in the solid form, batchwise. If necessary, any acid that forms is neutralized. At the end of the reaction, the resulting solid is suctioned off, washed and dried. With a view toward optimal yields, the reactants, DADPyOx and the salt of the transition metal are reacted in stoichiometric proportions. Two moles of DADPyOx are necessary in complexing with one mole a divalent transition metal; whereas when one mole of monovalent metal is complexed, only one mole of DADPyOx is needed.

Surprisingly, it is possible by this method to prepare novel, insensitive, high-energy compounds with the formula $Me(DADPyOx)_x$. Here, Me preferably stands for copper, nickel, cobalt, iron, silver, or zinc in its various possible oxidation states, x represents an integer of 1, 2, 3, or 4 and DADPyOx has the same meaning as heretofore noted. The novel compounds are extremely temperature-stable while the other properties critical for a high-energy explosive are essentially not disadvantageously affected. This is all the more surprising in that, in general, metal ion additives are regarded as ballast in explosives, and are expected considerably to reduce the rate of detonation. Surprisingly, compounds are obtained according to the invention which, under the same measurement conditions, have detonation rates of approximately the same order of magnitude as the starting compound, i.e. DADPyOx.

DETAILED DESCRIPTION OF THE INVENTION

The novel compounds have mechanical properties comparable to those of TNT (trinitrotoluene). For compounds according to the invention $Ni(DADPyOx)_2$ and $Cu(DADPyOx)_2$, the values given in Table I were obtained:

TABLE I

| | Impact sensitivity | Friction sensitivity |
|---|---|---|
| $Cu(DADPyOx)_2$ | 15 J | >360 N |
| $Ni(DADPyOx)_2$ | 15 J | 240 N |
| DADPyOx | 15 J | >360 N |
| TNT | 15 J | 360 N |

Table II shows surprisingly high temperature stability:

TABLE II

| | Decomposition point |
|---|---|
| $Cu(DADPyOx)_2$ | 364° C. |
| $Ni(DADPyOx)_2$ | 370° C. |
| DADPyOx | 355° C. |
| TNT | 300° C. |

Detonatability is determined by what is known as the "boundary initial test" (H. Jobelius, H. Zollner; 22nd International Seminar of the Fraunhofer Institute for Propellants and Explosives, ICT, Karlsruhe (1991), pages 79-1 to 79-13). In this test, in a standard cap structure with cap diameters of 7 to 8 mm, between 50 and 100 mg of the substance under test is coated with various quantities of lead azide and triggered. Penetration of a lead plate was used to demonstrate detonation. PETN (pentaerythritol tetranitrate), tetryl (trinitrophenylmethylnitramine), and HMX (1,3,5,7-tetranitro-1,3,5,7-tetraazacyclooctane) were used as comparison substances. The results are given in Table III. Surprisingly, the compounds according to the invention, as in the boundary initial test, were detonatable even at relatively small diameters:

TABLE III

| | Boundary initial test |
|---|---|
| $Cu(DADPyOx)_2$ | 30 mg |
| $Ni(DADPyOx)_2$ | 20 mg |
| PETN | 10 mg |
| Tetryl | 20 mg |
| HMX | 40 mg |

The approximate detonation rate was tested on a laboratory scale with a simple experimental arrangement with SIP pressure sensors ("pressure-wave-induced polarization") (F. E. Allison; J. Appl. Phys. 36 (1965), 211; G. E. Hauver; J. Appl. Phys. 36 (1966), 2113). The method chosen has the advantage that it can be carried out with quantities of substance as small as 2 g. As well as demonstrating detonatability and estimating the rate of detonation, the detonation pressure can also be roughly estimated. For $Cu(DADPyOx)_2$, a detonation rate of approximately 5,500 m/s and a detonation pressure of approximately 150 kbar at a compressed density of 1.46 g/ml was determined; for $Ni(DADPyOx)_2$, the detonation rate was approximately 5,400 m/s. The maximum density was determined in a pyknometer for $Cu(DADPyOx)_2$ as being 2.07 g/ml and for $Ni(DADPyOx)_2$ as 2.03 g/ml. Under the same measurement conditions, DADPyOx had a detonation rate of approximately 5,900 m/s.

The following examples further illustrate the present invention.

EXAMPLE 1

2.273 g (10.57 mmol) DADPyOx were suspended in 200 ml glacial acetic acid. While stirring, 1.289 g (5.34 mmol) $Cu(NO_3)_{2.3}\cdot 3H_2O$ was added to this as a solid, batchwise. The color of the suspension changed from yellow to green at this point. The solid was suctioned off and Washed three times with 30 ml glacial acetic acid. After air drying overnight, it was dried further at $10^{-2}$ torr. The yield was 2.00 g (76% of theoretical yield).

| | |
|---|---|
| $C_{10}H_8CuN_{10}O_{10}$ | MW = 491.776 g/mol |
| Decomposition point | No decomposition up to 360° C. |
| Color | Ocher-yellow |

Element analysis: Calc. C 24.42% H 1.64% N 28.48% Cu 12.92% Found 25.14% H 1.80% N 28.69% Cu 12.41%

EXAMPLE 2

5.022 g (23.35 mmol) DADPyOx was suspended in 500 ml of glacial acetic acid. While stirring, 3.394 g (11.67 mmol) $Ni(NO_3)_2\cdot 6H_2O$ as a solid was added batchwise at room temperature. The suspension had a bright yellow color. It was heated to the reflux point while stirring and held for 1.5 hours. At an internal temperature of 100° C., the color changed in a short time to a reddish-brown. After cooling, the solid was suctioned off and washed three times with 50 ml glacial acetic acid. After air drying overnight,. it was further dried at $10^{-2}$ torr. The yield was 3.39 g (60% of theoretical).

| | |
|---|---|
| $C_{10}H_8NiN_{10}O_{10}$ | MW = 486.930 g/mol |
| Decomposition point | No decomposition up to 360° C. |
| Color | Reddish-brown |

Element analysis: Calc. C 24.67% H 1.66% N 28.77% Cu 12.06% Found C 25.14% H 1.66% N 28.44% Cu 11.73%

From the foregoing Examples, it will be understood, the reaction conditions for forming the metal complex compounds are dependent on the reactivity of the salts of the transition metals used. Room temperature or higher temperatures may be used, e.g., at the boiling point of the suspending agent as shown in Example 2. Atmospheric pressure is usual. Also, the amount of suspending agent is approximately 100 ml per 1 gram of DADPyOx.

What is claimed is:

1. A metal complex compound with the general formula $Me(DADPyOx)_x$ where Me stands for a transition metal ion, DADPyOx stands for 2,6-diamino-3,5-dinitropyridine-1-oxide and x represents an integer of 1, 2, 3, or 4.

2. The metal complex compound according to claim 1, wherein Me is an ion of a transition metal selected from the group consisting of copper, nickel, cobalt, iron, silver and zinc in their various oxidation states and the value of x is dependent upon the oxidation state of the transition metal.

3. The metal complex compound according to claim 1, wherein the compound has the formula $Cu(DADPyOx)_2$.

4. The metal complex compound according to claim 1, wherein the compound has the formula $Ni(DADPyOx)_2$.

5. A method for preparing metal complex compounds having the general formula $Me(DADPyOx)_x$ where Me stands for a transition metal ion, DADPyOx stands for 2,6-diamino-3,5-dinitropyridine-1-oxide and x represents an integer of 1, 2, 3, or 4, wherein DADPyOx is reacted with a transition metal salt for providing one of said transition metal ions in an appropriate suspending agent.

6. The method for preparing metal complex compounds according to claim 5, wherein said transition metal salt is a chloride, sulfate, carbonate, or nitrate of a transition metal selected from the group consisting of copper, nickel, cobalt, iron, silver and zinc.

7. The method for preparing metal complex compounds according to claim 5, wherein glacial acetic acid, dimethylformamide, or water is used as the suspending agent.

8. The method for preparing metal complex compounds according to claim 5, wherein $Ni(NO_3)_2 \cdot 6H_2O$ or $Cu(NO_3)_2 \cdot 3H_2O$ is the transition metal salt.

9. An insensitive, highly temperature-stable explosive containing a metal complex compound with the general formula $Me(DADPyOx)_x$ where Me stands for a transition metal ion, DADPyOx stands for 2,6-diamino-3,5-dinitropyridine-1-oxide and x represents an integer of 1, 2, 3 or 4.

10. A blasting cap containing a metal complex compound with the general formula $Me(DADPyOx)_x$ where Me stands for a transition metal ion, DADPyOx stands for 2,6-diamino-3,5-dinitropyridine-1-oxide and x represents an integer of 1, 2, 3 or 4.

11. A burn-up moderator containing a metal complex compound with the general formula $Me(DADPyOx)_x$ where Me stands for a transition metal ion, DADPyOx stands for 2,6-diamino-3,5-dinitropyridine-1-oxide and x represents an integer of 1, 2, 3 or 4.

* * * * *

UNITED STATES PATENT AND TRADEMARK OFFICE

CERTIFICATE OF CORRECTION

PATENT NO. : 5,578,785

DATED : November 26, 1996

INVENTOR(S) : FIEDERLING, et al

It is certified that error appears in the above-indentified patent and that said Letters Patent is hereby corrected as shown below:

On the title page, left-hand column,

"[75] Inventor: Nikolaus Fiederling, Leverkusen, Germany"

should read:

-- [75] Inventor: Nikolaus Fiederling, Leverkusen, Germany; Cornelius Ruloff, Leverkusen, Germany --

Signed and Sealed this

Eighteenth Day of March, 1997

Bruce Lehman

*Attest:*

BRUCE LEHMAN

*Attesting Officer*

*Commissioner of Patents and Trademarks*